US006815607B1

(12) United States Patent
Gingras

(10) Patent No.: US 6,815,607 B1
(45) Date of Patent: Nov. 9, 2004

(54) GROUNDING METHOD AND ASSOCIATED POLE SUPPORT SYSTEM

(76) Inventor: Marc Gingras, 158 Chemin Val des Bois (BG #28-0), Val Senneville, Quebec (CA), J0Y 2P0

( * ) Notice: Subject to any disclaimer, the term of this patent is extended or adjusted under 35 U.S.C. 154(b) by 0 days.

(21) Appl. No.: 10/111,855

(22) PCT Filed: Jan. 11, 2000

(86) PCT No.: PCT/CA00/01301

§ 371 (c)(1),
(2), (4) Date: Apr. 30, 2002

(87) PCT Pub. No.: WO01/33671

PCT Pub. Date: May 10, 2001

Related U.S. Application Data

(60) Provisional application No. 60/162,784, filed on Nov. 1, 1999.

(30) Foreign Application Priority Data

Nov. 1, 1999 (CA) ..... 2287749

(51) Int. Cl.[7] ..... H01R 4/66
(52) U.S. Cl. ..... 174/7; 174/6
(58) Field of Search ..... 174/1, 2, 5 SG, 174/6, 7, 10, 45 R

(56) References Cited

U.S. PATENT DOCUMENTS 347,602 A * 8/1886 Herron ..... 174/45 R
377,337 A * 1/1888 Tourgee ..... 174/7
414,943 A * 11/1889 Dewey ..... 174/6
1,737,562 A * 12/1929 Borden ..... 174/7
1,976,919 A * 10/1934 Byrne ..... 174/7
2,068,545 A * 1/1937 Haig ..... 174/7
2,111,799 A * 3/1938 Newpher ..... 174/7
2,303,861 A * 12/1942 Pennell ..... 174/6
2,455,641 A * 12/1948 Badeau et al. ..... 174/6
2,545,048 A * 3/1951 Salmons ..... 174/6
3,060,257 A * 10/1962 Spurgeon ..... 174/7
6,040,522 A * 3/2000 Beggs ..... 174/7
6,137,049 A * 10/2000 Hecock ..... 174/7

* cited by examiner

*Primary Examiner*—Anthony Dinkins
*Assistant Examiner*—Adolfo Nino
(74) *Attorney, Agent, or Firm*—Hodgson Russ LLP

(57) ABSTRACT

The invention relates to a method and apparatus for electrically grounding and supporting poles or posts which are used in electrical and/or telecommunication networks. The system includes a conductive base support affixed at or near the base of the pole and to which the ground wire is attached. The base support not only provides resistance to lateral forces, thereby anchoring the bottom of the pole, but also presents a relatively large surface area for electrical bonding with the soil/earth at the bottom of the pole which facilities grounding.

12 Claims, 7 Drawing Sheets

GROUNDING METHOD AND ASSOCIATED POLE SUPPORT SYSTEM

This application claims the benefit of Provisional application No. 60/162,784, filed Nov. 1, 1999.

FIELD OF THE INVENTION

The invention relates to techniques for grounding electrical and telecommunication networks which are, at least in part, carried by utility poles, and to a pole support system for use with the grounding method.

BACKGROUND OF THE INVENTION

All electrical, telecommunication, and cable TV distribution networks (aerial or buried) require that all components within these systems have a reference ground for their proper operation under normal use and to also provide electrical protection when faults occur. These faults may include, but are not necessarily limited to:

1. Failure of components within the system;
2. Thunder storms (lightning strikes);
3. Trees or debris falling on electrical conductors (wind and ice storms):
4. Vehicle collisions (car and truck) with the outside plant (poles, pedestals); and
5. Failure of components on customer premises (private substations, major faults within factories etc.)

Conventional grounding of these outside plant distribution networks is accomplished mainly by connecting all common ground components of all service providers on a given pole to the neutral wire (usually belonging to the electrical utility company) and running a common wire down the pole. This wire is then put to ground where it should provide an efficient common ground for the proper operation of the service provider networks and to ensure that any power surges will be shunted to earth as quickly and efficiently as possible.

Thus the efficiency of protection will depend largely on the quality of the wire's electrical bond (wire running down the pole) with the earth. This electrical bond is established through mechanical means. Acquiring and maintaining quality, earth bonds have always challenged the industry.

Conventionally, industry has used galvanized ground rods (¾ inch diameter by 6 to 8 feet in length) which are hammered into the earth at approximately 16 to 18 inches from the pole. Using a mechanical clamp (sometimes a welded connection) the ground wire is attached. This technique has always given generally unsatisfactory results. The reasons for this being:

1. Rods offer relatively small surface area bonds with the soil thus electrical conductivity is limited (higher impedance);
2. A good portion of the rod (approx. ⅓) resides in relatively dry earth near the surface (conductively is thus limited);
3. Rods protrude and are a safety hazard for people;
4. The connection to the clamp is subject to damage (intentional or accidental); and
5. Rods tend to rust at the surface level and must be replaced periodically (approx. every 8 to 10 years depending on soil conditions).

It is also known from U.S. Pat. No. 2,645,048, issued Mar. 13, 1951 to Salmons, to use a pole butt ground plate consisting of a flat plate which approximates the shape of the butt of the pole and having a plurality of triangular prongs extending therefrom and cut from the material of the plate. Since the prongs engage ground on both sides, a better ground is said to be provided as compared with a butt plate which does not have such prongs. Furthermore, the prongs are said to keep the pole butt from shifting in the hole while the fill is being replaced around the pole during installation. It has been found that in installations utilizing wooden utility poles such as shown in U.S. Pat. No. 2,545,048, creosote is exuded from the bottom end of the pole which tends to flow along and coat surfaces nearest the bottom of the pole, particularly horizontal surfaces of such bearing plates, resulting in decreased grounding efficiency. A further problem with such bearing plates is that they tend only to make contact with the soil/ground at or immediately adjacent th bottom of the hole. When the holes for utility poles are drilled or otherwise excavated in the ground there remains at the bottom of the hole a significant amount of disturbed soil/ground consisting of loose debris which has fallen to the bottom of the hole as well as soil/ground at the bottom of the bole which has been agitated by the excavation process. Such soil/ground which has been disturbed does not provide the best contact with the plate for grounding purposes as it is not as compact as the undisturbed soil beneath the hole. The disturbed ground is also m re oxygenated which promotes rusting of the bearing plate.

Reference is made to Applicant's prior U.S. Pat. No. 5,108,068, issued Apr. 28, 1992, and in a corresponding PCT Appilcaton No. PCT/CA92/00177, filed Apr. 27, 1992, both entitled Support System for Free Standing Poles or Posts, and both incorporated herein in their entirety by reference. Therein is described a pol anchoring system comprising one or more collars each having a plurality of blades or flukes pivotably connected thereto. An installation instrument is used to deploy the collar(s) within a hole and to extend the blades of the collar(s) in a generally radial direction causing the blades to penetrate the walls of the hole and thus securing the support collar therein. The pole is then inserted through the collar(s) whereby the collar(s) provide the necessary support to the base of the pole to resist lateral and/or rotational forces. The blades, which are extended into undisturbed soil around the hole, provide a substantial surface area to distribute the exerted forces. Applicant's system replaces the traditional double-keying technique and eliminates the need for guy wires or push braces (and the associated additional real estate required therefor) which clutter the landscape and unavoidably tear up the surrounding soil. In using this system, no excavation of the poles location is required other than a hole slightly larger than the diameter of the pole, drilled to plant the pole or post in the ground using standard drilling methods now in use.

SUMMARY OF THE INVENTION

Applicant has realized that by fitting the base of the pole with a base support which can penetrate the generally undisturbed ground or soil at the bottom of the drilled hole when the pole is lowered, not only can additional lateral resistance be provided but the installation process can be shortened and thus made more efficient.

In general, the base support has a relatively large surface area for presentation against the applied forces which act on the pole in both rotational and lateral/transverse directions. The base support includes means for attaching it at or near the base of the polo and any leading edges can be angled to facilitate penetration into the generally undisturbed soil/ground "below" the bottom of the hole.

By connecting the pole's electrical ground wire to an electrically conductive base support, an efficient grounding electrode is provided which will save both time and money for the industry and provide safer and more reliable services to the population.

More specifically, there is provided a method for the electrical grounding and support of a pole or post in a hole provided in undisturbed ground, the hole having disturbed ground at the bottom thereof beneath which is undisturbed ground, said method comprising:

providing a conductive base support whose surfaces are oriented predominantly in the vertical direction, attaching a ground wire to said conductive base support;

attaching the conductive base support at or near the bottom of the pole or post prior to its installation in the hole in the ground such that at least a portion of the conductive base support extends below the bottom of the pole or post;

installing the pole or post in the hole such that the portion of the conductive base support which extends below the bottom of the pole or post penetrates the undisturbed ground beneath the disturbed ground at the bottom of the hole; and connecting the ground wire to the electrical system of the pole or post.

There is also provided a combination pole support and electrical grounding arrangement for a pole being installed in a hole in undisturbed ground, the hole having disturbed ground at the bottom thereof beneath which is undisturbed ground, comprising:

a conductive base support whose surfaces are oriented predominantly in the vertical direction;

connection means for attaching a ground wire to said base support;

means for fastening the base support at or near the base of a pole such that at least a portion of the conductive base support extends below the bottom of the pole;

said portion of the conductive base support extending a sufficient length so as to be penetrable into the undisturbed ground beneath the disturbed ground at the bottom of the hole and so as to be engageable with the undisturbed ground beneath the hole to resist lateral and/or rotational forces exerted on the pole after installation.

The advantages in using such a conductive base support as a grounding electrode are:

1. The base support offers 4 to 5 times more surface area bonding with the soil than traditional grounding rods, thus electrical conductivity is optimized (lower impedance);
2. The base support resides entirely in generally undisturbed, cool moist earth under the pole which is approximately 5 to 10 feet underground (depending on the depth the pole is set), thus electrical conductivity is optimized (lower impedance). The undisturbed earth also tends to provide greater resistance against movement of the support and, hence, the pole or post;
3. No portion of the base support, nor its connection to the wire, is exposed to potential damage;
4. The possibility of base support rusting is minimal as there is very little oxygen to promote oxidation at 5 to 10 foot depths, especially in undisturbed soil/ground beneath the bottom of the hole (whereas soil/ground which has been exposed or which has been used as fill will have relatively high oxygen content). Thus the base support should match the life expectancy of the pole; and
5. The base support doubles as support for the foot of the pole and thus increases its stability in the soil (helps prevent the pole from leaning under transverse loads or from twisting under rotational loads).

Typically, in applications involving electric utility poles, grounding is effected at regular pole intervals and on each pole having a transformer. Accordingly, there is an enormous potential for a highly efficient, readily implementable grounding technique.

Further features and advantages of the invention will become more apparent from the following description of the preferred embodiment when taken in connection with the accompanying drawings.

DETAILED DESCRIPTION OF THE INVENTION

Figure 1:
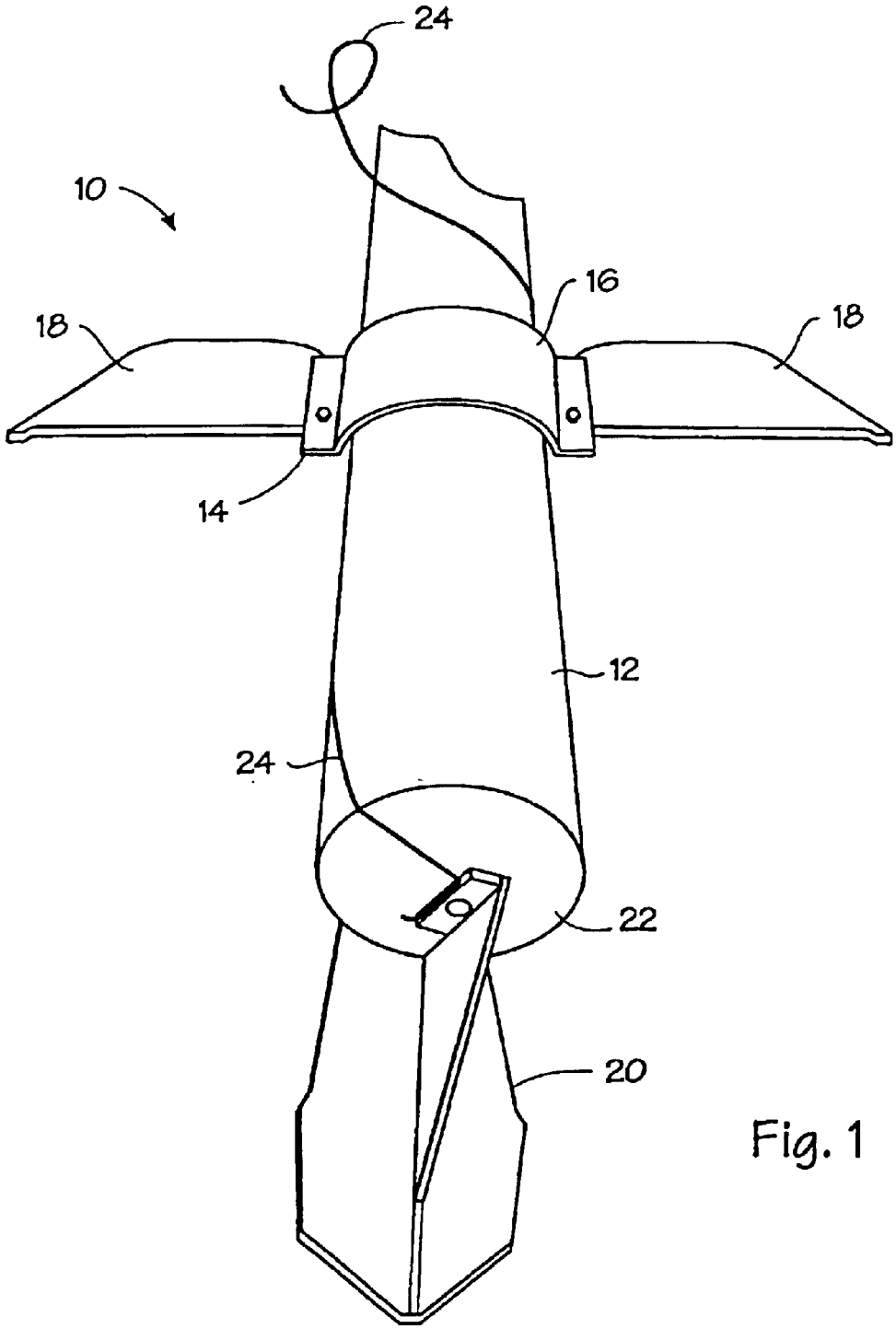
FIG. 1 is a perspective view from the bottom front illustrating the base support and optional collar arranged on a pole along with the associated ground wire.
Figure 2A:
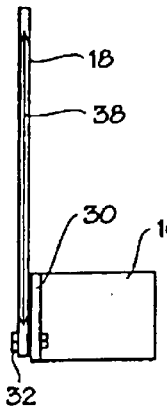
FIG. 2*a* is a side elevational view of the collar assembly having its blades in their generally vertical installation position.
Figure 2B:
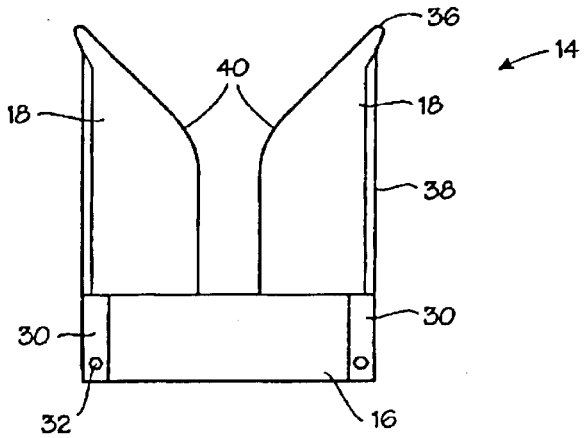
FIG. 2*b* is a front elevational view of the collar assembly shown in FIG. 2*a;*
Figure 3A:
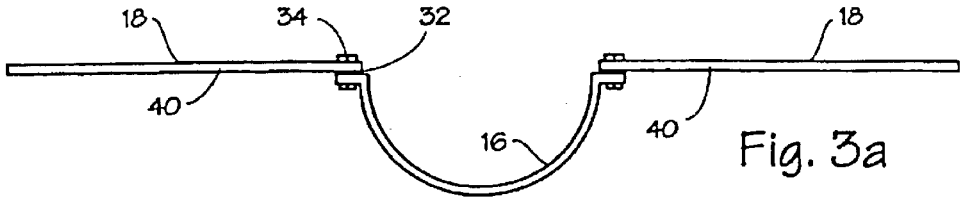
FIG. 3*a* is a plan view of the collar assembly having its blades in their extended deployment position.
Figure 3B:
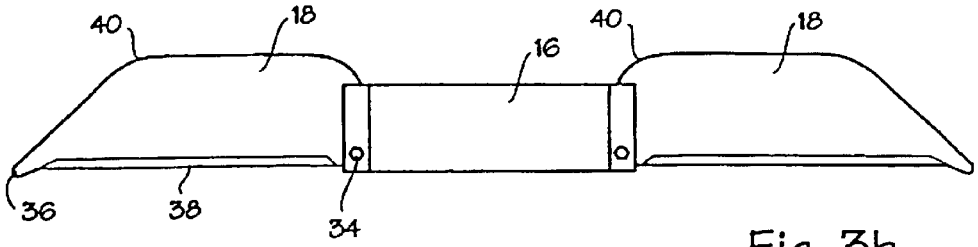
FIG. 3*b* is a front elevational view of the collar assembly shown in FIG. 3*a*.
Figure 3C:
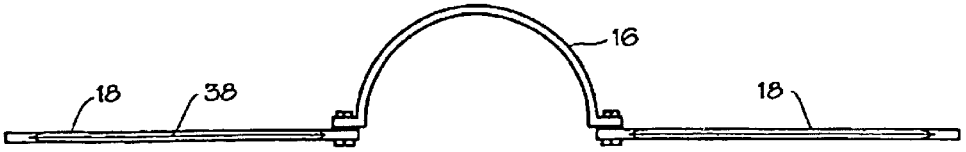
FIG. 3*c* is a bottom view of the collar assembly of FIG. 3*a;*

Referring to FIG. 1, Applicant's pole support is shown generally at 10 installed on an out of the ground pole or post 12 for the purposes of illustration. The support 10 comprises at least one collar assembly 14 having an arcuate collar portion 16 and preferably a pair of blades 18 pivotably attached thereto. The base support 20, which is affixed to the base 22 of pole 12, has a ground wire 24 attached thereto that runs up the pole and directly to the aerial ground network.

The collar assembly 14 is shown in greater detail in FIGS. 2*a*, 2*b* and 3*a*–3*c*. The arcuate collar portion 16 is provided with a pair of outwardly extending flanges 30 to each of which is pivotably connected a respective blade 18 by means of any suitable form of fastener 32. The fastener 32 can be inserted through respective holes in the flange 30 and the blade 18 and tightened to guard against unfastening yet to permit relative rotation between the blade 18 and the flange 30. To this end, a low friction spacer 34 may be employed between the blade 18 and the flange 30.

The shape of the arcuate collar portion 16 is shown as semicircular thus the blades 18 are diametrically opposed. In most instances, the direction of the forces on the pole are known and, accordingly, a collar assembly with diametrically opposed blades can be positioned to maximize resistance to those forces. However, where the direction of the forces is less obvious or where the direction of forces will be variable to a certain degree, such as with wind, the shape of the arcuate portion 16 can be more than or less than 180°. Where bi-directional support is required, a second semicylindrical collar portion (not shown) could be utilized between which the blades are pivotably disposed. Alternately, a second collar assembly 14 could be deployed above a first, but oriented such that the blades 18 are generally at right angles to the blades of the first.

The blades 18 are shaped so as to facilitate their penetration into the earth with as little disruption to the surrounding soil/ground as possible. To this end, the blades 18 preferably have a pointed tip at the end distal their point of rotation. In addition, the lateral edge 38 of the blade 18 may be "sharpened" to reduce resistance as the blade 18 slices into the earth. Opposite the lateral edge 38 there is provided a curvilinear bearing edge 40 whose purpose will be described hereinafter.

Both the blades 18 and the arcuate collar portion 16 can be fabricated from steel or similar high-strength material which, depending on the type of material, may be galvanized or otherwise treated with a rust-inhibiting finish. Prototypes which have been made for utility pole installations have blades which are approximately 20 inches (0.5 m) in length and 7 inches (18 cm) wide. Depending on the diameter of the collar portion 16, the span of the blades 18 when fully extended is on the order of 60 inches (1.5 m). The arcuate collar portion 16 can be provided with various radii of curvature to match or approximate typical standard pole sizes. Such collar assemblies can weigh 55–60 lbs (25–28 kg).

Figure 4A:
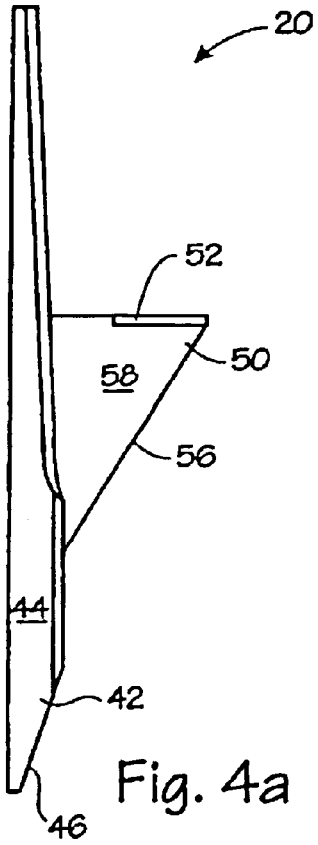
FIG. 4*a* is a side elevational view of the base support.
Figure 4B:
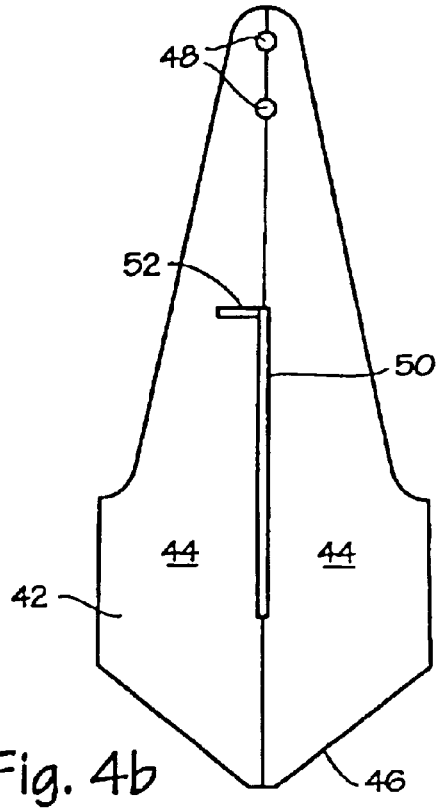
FIGS. 4*b* and 4*c* are front elevations and bottom views, respectively, of the base support of FIG. 4*a;*
Figure 4C:
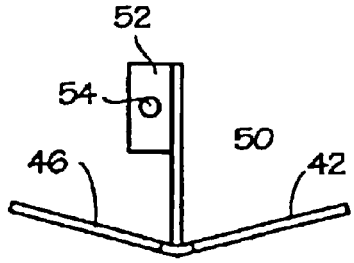

The preferred configuration of the base support 20 is shown in greater detail in FIGS. 4*a*–4*c*. The base support 20 comprises a generally vertical spade portion 42 having a tapered leading edge 46 designed to penetrate into the undisturbed ground at the bottom of the hole under the weight of the pole. The term "vertical" as used herein generally refers to the operative orientation of the respective component. The spade portion 42 presents large surface areas 44 to resist lateral and/or rotational movement of the lower end of the pole 12. The base support 20 is attached to the pole (see FIG. 1) by bolts, screws or other fasteners (as appropriate to the type of pole material) driven through holes 48 provided at the upper end of the spade portion 42. To reduce the stress on these fasteners when the pole is being lowered (and thus when the spade portion 42 is penetrating the hole bottom, a vertically oriented driving member 50 is provided which extends generally transversely from the spade portion 42. At the upper end of the driving member there may be provided a horizontally extending tab 52 designed to abut the base 22 of pole 12. A hole 54 is provided in tab 52 so that yet another fastener can be used to further secure the base support 20 to the base 22 of the pole 12 if desired. If provided, the tab 52 is preferably relatively small and only of sufficient size to accommodate the fastener. It has been found that in installations utilizing wooden utility poles, creosote is exuded from the bottom end of the pole which tends to flow along and coat surfaces nearest the bottom of the pole, particularly horizontal surfaces common in bearing plates, resulting in decreased grounding efficiency. A further problem with bearing plates is that they tend only to make contact with the soil/ground at or immediately adjacent the bottom of the hole. Such soil/ground has been disturbed thus does not provide the best contact with the plate for grounding purposes should it be used therefor. The disturbed ground is also more oxygenated which promotes rusting of the bearing plate. Furthermore, since bearing plates are typically of the same size as the pole, they provide little if any additional vertical support for the pole than the flat bottom of the pole itself.

Returning to FIG. 4*a*, the leading edge 56 of driving member 50 is inclined to facilitate penetration into the ground while the relatively large vertical surface areas 58 serve to resist forces which would be transverse to the forces resisted by the surfaces 44 of the spade portion 42. Thus, not only does the base support 20 provides comprehensive support to the base 22 of the pole 12 against lateral and/or twisting movement, but presents a large surface area in contact with moist, undisturbed soil for efficient grounding. In addition, the length to which the spade portion 42 extends below the base 22 of the pole 12 increases the effective setting depth of the setting of the pole 12 resulting in increased leverage and, consequently, an increase in a given pole's stability.

The base support 20 is fabricated from an electrically conductive material, preferably steel. While rusting is inhibited by the low oxygen levels in the undisturbed ground at the depth to which the pole is set, the base support is preferably galvanized or coated, treated or otherwise provided with a corrosion resistant finish to prolong its life. Such a finish, if provided, should not impede electrical conduction to the surrounding soil. Alternately, the material from which the base support 20 is fabricated can itself be resistant to oxidation. Typical dimensions for the base support 20 for use in utility pole installations are: approximately 30–35 inches (0.75–0.90 m) from top to bottom; 12–14 inches (30–35 cm) in width; and ⅜ inch (9.5 mm) thick. The driving member 50 is roughly 12–14 inches (30–35 cm) in height and 7–8 inches (17–21 cm) wide at its upper end. It will be appreciated that these dimensions give rise to considerable surface area, on the order of 800 sq. in. (5160 $cm^2$) for grounding purposes. Compare this with a surface area of 169–226 sq. in. (1090–1460 $cm^2$) for a typical ¾" (1.9 cm) grounding rod which is 6–8 feet (1.8–2.5 m) in length, which presumes the entire rod is below ground.

As shown best in FIG. 4*c*, the spade portion 42 is preferably angled with an included angle of about 150°. While the spade portion 42 may be curved to match the circumference of the pole 12 (while still having a generally vertical surface), a curved spade is more difficult and hence costlier to manufacture. Also, a single angled spade 42 can be used to approximate the curvature of most sizes of utility poles instead of having to provide a variety of curved spades of varying curvatures. The angled spade can also be designed to approximate the shape of the hole in which the pole is installed whereas the lateral edges of a flat spade could interfere with the sides of the hole during lowering.

Figure 5A:
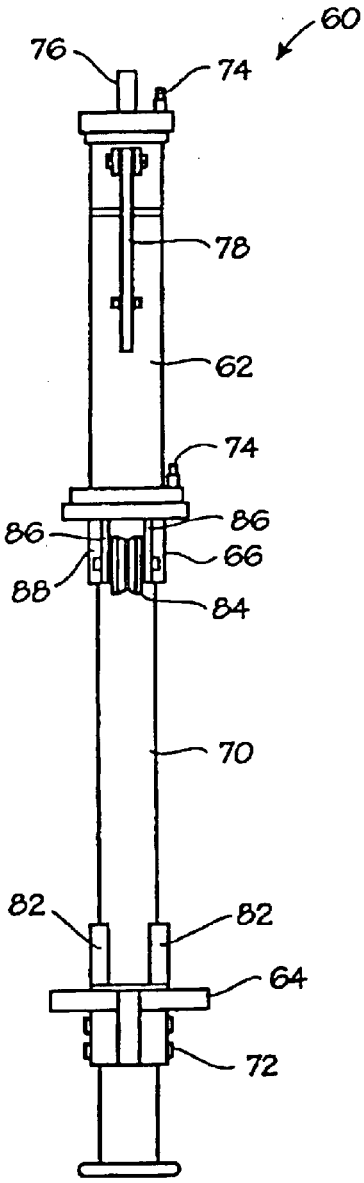
FIGS. 5*a* and 5*b* are side and front elevational views, respectively, of an installation instrument usable to deploy the collar assembly into a hole in the ground.
Figure 5B:
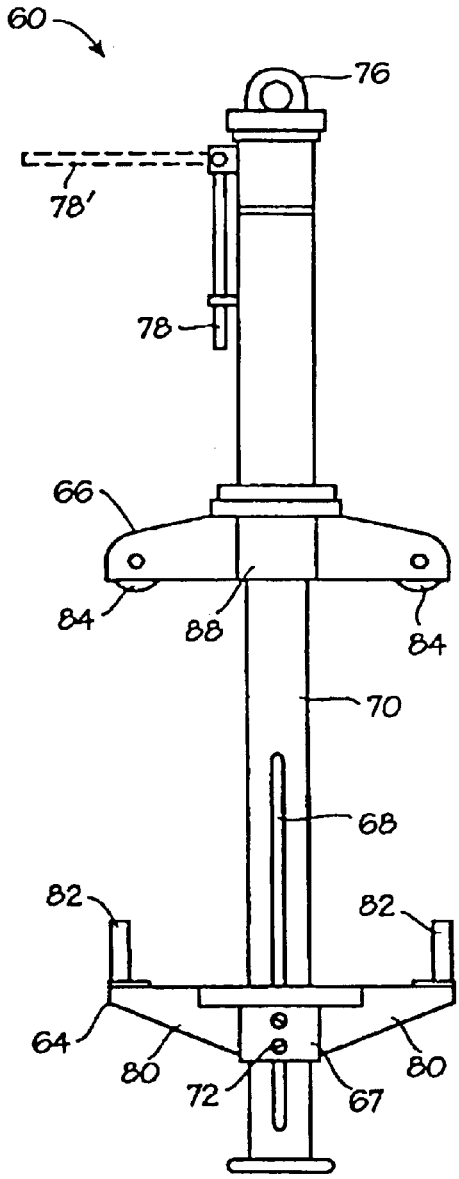

FIGS. 5*a* and 5*b* show the installation instrument 60 which is used to deploy the collar assembly 14 and, more specifically, which is used to extend the blades 18 radially outwardly to penetrate the side walls of the hole in which the pole is to be inserted. The installation instrument 60 comprises a hydraulic cylinder 62 having a ram operable to translate an actuator 64 toward and away from thrust deflector 66. The annular body 67 of actuator 64 is connected to the ram through a longitudinal slot 68 in barrel 70 by suitable fasteners 72. The ram is actuated by a supply of hydraulic fluid provided via hydraulic lines (not shown) attached to hydraulic connectors 74.

Atop the installation instrument 60 a clevis 76 is provided to which a cable or chain can be attached to assist in supporting the installation instrument 60 lowering it into a hole in the ground and raising it out of the hole once the collar assembly 14 is deployed. To further assist with positioning, a retractable handle 78, shown in its retracted position, may be extended to a position 78', shown in phantom in FIG. 5*b*, to facilitate rotation of the installation instrument 60 to ensure the collar blades 18 are appropriately positioned with respect to the direction of anticipated forces.

Figure 6A:
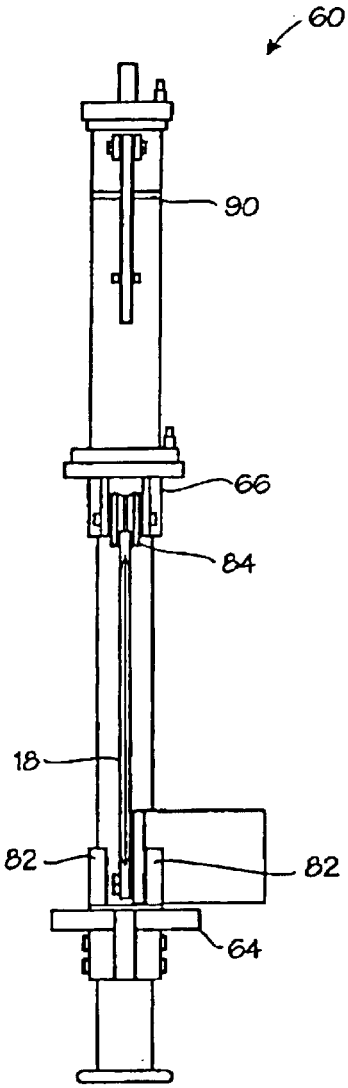
FIGS. 6*a* and 6*b* are side and front elevational views, respectively, similar to FIGS. 5*a* and 5*b*, but showing the collar assembly disposed on the installation instrument.
Figure 6B:
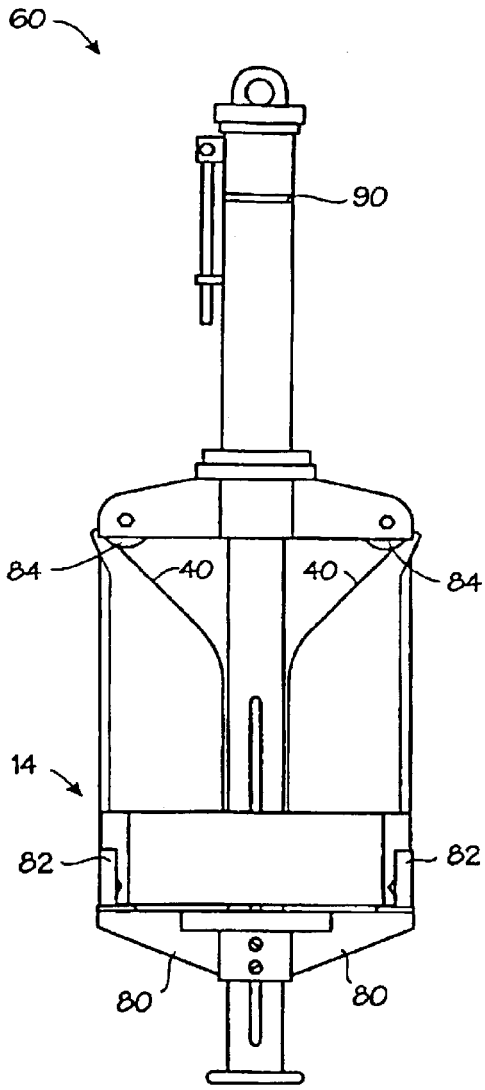

As can be seen in FIGS. 6*a* and 6*b*, the actuator 64 provides initial support for the collar assembly 14 during insertion of the installation instrument 60 into the hole in the ground. The actuator 64 includes a pair of arms 80 that each support a pair of posts 82. The space between the posts 82 accommodates the flange 30 and its associated blade 18.

The thrust deflector 66 includes a cantilevered roller 84 against which the bearing edge 40 of blades 12 are cammed as the actuator 64 is translated toward the thrust deflector 66 which results in the blades 18 arcing radially outwardly. Each roller 84 is supported by a pair of parallel flanges 86 extending outwardly from an annular body 88 at the lower end of the hydraulic cylinder 62.

To enable ready determination of the deployment depth of the collar assembly, a reference line 90 may be provided on the hydraulic cylinder.

Figure 7A:
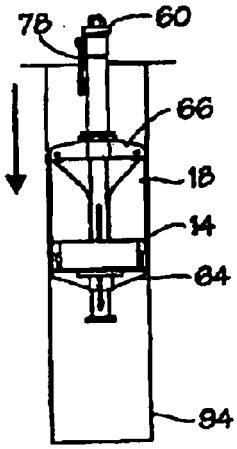
FIGS. 7*a* through 7*f* are side views which sequentially illustrate the installation of the pole and its grounding.

The installation of a grounded pole is illustrated sequentially in FIGS. 7*a* through 7*f*. A standard soil drilling instrument (not shown) is utilized to bore a hole 94 of a predetermined depth and diameter into the ground using known techniques. The collar assembly 20 is positioned on the installation instrument 60 between the actuator 64 and the thrust deflector 66 (as shown in FIG. 6*b*) with the blades 18 in their generally vertical installation position. The installation instrument 60 and collar assembly 20 are then lowered into the hole 94 as shown in FIG. 7*a*. The handle 78 may be used to orient the angular position of the installation instrument 60 and hence the blades 18.

Figure 7B:
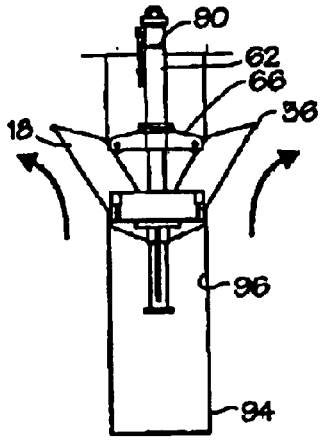
Figure 7C:
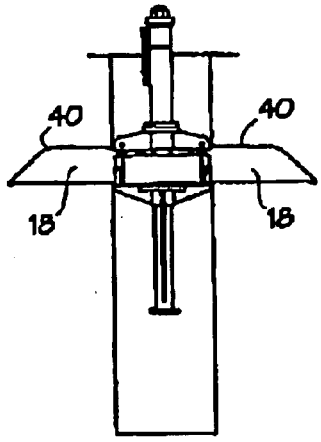
Figure 7D:
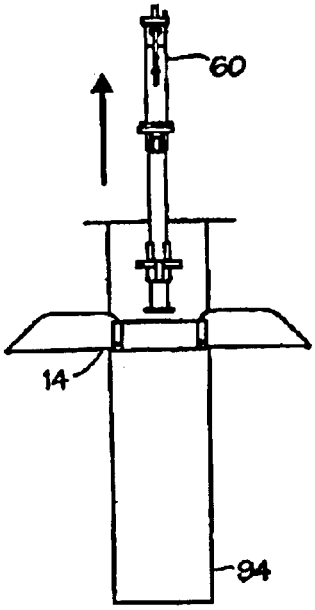
Figure 7E:
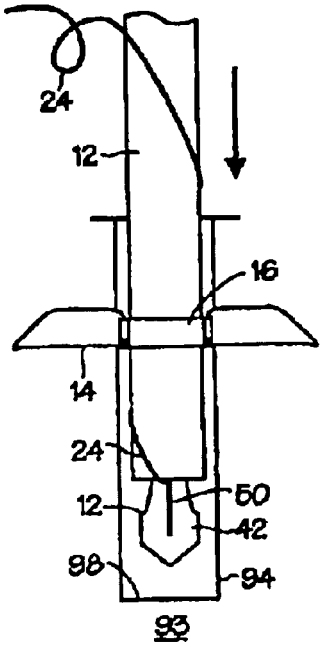
Figure 7F:
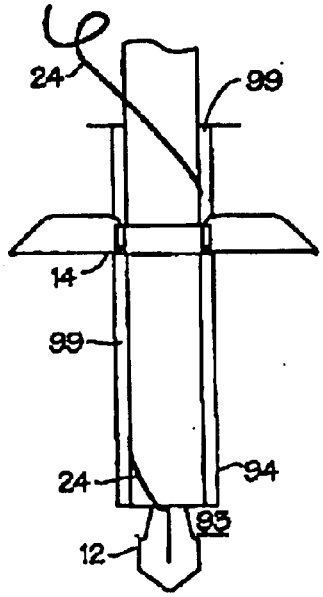

When the installation instrument 60 is at a predetermined depth as indicated with respect to the reference line 90, the hydraulic jack 62 is operated to cause the actuator 64 to move towards the thrust deflector 66 (see FIG. 7*b*). The bearing edge 40 of each blade 18 engages a respective roller 84 of the thrust deflector 66 whereby the bearing edge's curvature causes the tip 36 to arc radially outwardly, to pierce the wall 96 of the hole 94 and to penetrate out into the surrounding ground (see FIG. 7*c*).

The installation instrument 60 is then removed by reversing the hydraulic cylinder 62 which causes the actuator 64 to lower, leaving the collar assembly 14 fully deployed. Once the alignment of the flanges 30 and the posts 82 of the actuator 64 has been broken, the installation instrument 60 can be manipulated and removed from the hole 94 (see FIG. 7*d*).

Figure 8A:
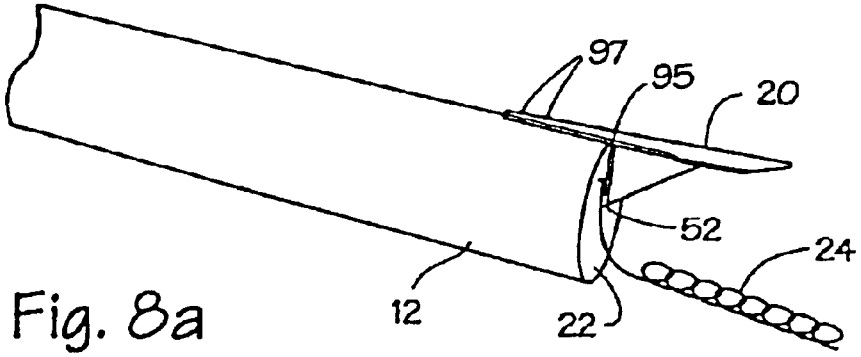
FIG. 8*a* is a perspective view which illustrates the manner by which the base support and ground wire is attached to the pole.

The base support 20 is fastened to the bottom end of the pole 12. Ground wire 24, which may be welded (as shown in FIGS. 1 and 8*a*), rivetted or otherwise fastened to tab 52, drive member 50, spade portion 42 or any other suitable/convenient location on base support 20, is preferably factory-attached for better quality control and to reduce the amount of on-site work. The pole 12, with the base support 20 and ground wire 24, is then lowered into the hole 94 (see FIG. 7*e*) and slidingly cupped by the arcuate collar portion 16 of the collar assembly 14 as the base support 20 penetrates into the undisturbed ground 93 at the bottom 98 of hole 94. Because the surfaces 44,58 of the support 20 are vertically oriented, penetration into the ground 93 is facilitated with minimal disturbance. The remaining portion 99 of the hole 94 is then backfilled with excavated soil or with crushed stone, which backfill is then compacted according to standard practice.

Figure 8B:
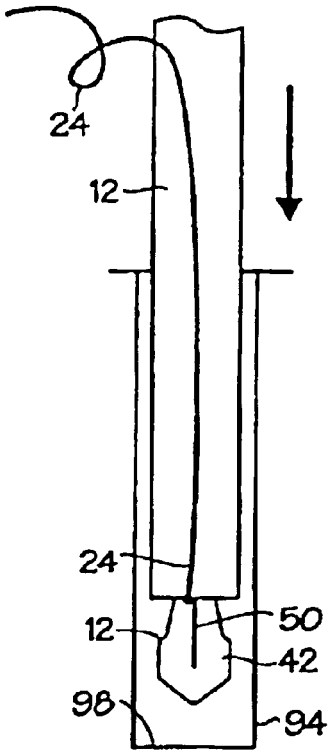
FIGS. 8*b* and 8*c* illustrate the method of installing a grounded pole without the supportive upper collar assembly.
Figure 8C:
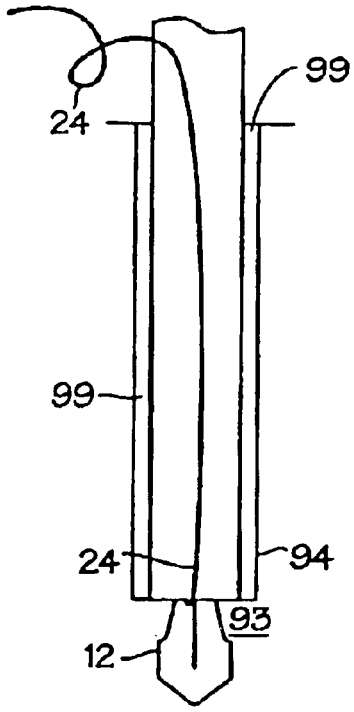

While the collar assembly 14 serves as an excellent and advantageous support for the upper part of the pole which extends underground, the grounding method in conjunction with the base support 20 may still be utilized in absence of the collar assembly. In this regard, the base support 20, with the attached ground wire 24, is affixed to the side of the pole 12 by suitable fasteners 97 driven through holes 48 (see FIG. 4*b*) in spade portion 42 and fastener 95 which fastens tab 52 to the base 22 of the pole 12 (see FIG. 8*a*). The pole 12 is then lowered, dropped or urged by the truck boom down into the hole 94 (see FIG. 8*b*) so as to cause the spade portion 42 and driving member 50 of the base support 20 to penetrate the undisturbed ground 93 at the bottom 98 of the hole 94 (see FIG. 8*c*). The remaining portion of the hole is backfilled and compacted. Standard techniques may then by used for the support of the pole, if necessary.

In instances where grounding of a pre-existing pole installation is desired, or when grounding is required to supplement or replace existing but deficient or defective grounding, the base support 20 itself can be used in a retrofitted grounding arrangement. Poles carry an inventory of cables, conductors, transformers and a variety of hardware and it is not always possible or is it practical to fit an existing pole with a conductive base support in order to improve grounding. In these cases a retro-fit is possible by installing the conductive base support at some distance from the pole as to not disturb its foundation and stability. The conductive base support 20 can be installed by fitted it to the bottom end of a pile driver and having the resulting assembly lowered by boom or back-hoe shovel into a pre-excavated hole next to the existing pole. The boom or shovel is then used to apply downward pressure at the upper end of the pile driver thereby forcing the conductive base (electode) into the undisturbed soil at the bottom of the hole. The pile driver is then removed and the end of the conductor wire is run to the surface next to the pole where it can be connected to grounding network and the hole is refilled.

Typically, in applications involving electric utility poles, grounding is effected on every fifth pole and on each pole having a transformer.

While a preferred embodiment has been shown and described, it will be appreciated that the invention is not necessarily limited thereto and obvious modifications and substitutions may be made without departing from the spirit and scope of the invention.

What is claimed is:

1. A method for the electrical grounding and support of a pole or post (12) in a hole (94) provided in undisturbed ground, the hole (94) having disturbed ground at the bottom (98) thereof beneath which is undisturbed ground (93), said method comprising;

providing a conductive base support (20) of a length greater than the width of the pole or post and whose surfaces (44,58) are oriented predominantly in the vertical direction;

attaching a ground wire (24) to said conductive base support (20);

attaching the conductive base support (20) at or near the bottom of the pole or post prior (12) to its installation in the hole (94) in the ground such that at least a portion of the conductive base support (20) extends below the bottom (22) of the pole or post (12) a distance greater than the width of the pole or post;

installing the pole or post (12) in the hole (94) such that the portion of the conductive base support (20) which extends below the bottom (22) of the pole or post (12)

penetrates the undisturbed ground (93) beneath the disturbed ground at the bottom (98) of the hole (94); and connecting the ground wire (22) to the electrical system of the pole or post.

2. A combination pole support and electrical grounding arrangement for a pole (12) being installed in a hole (94) in undisturbed ground, the hole (94) having disturbed ground at the bottom (98) thereof beneath which is undisturbed ground (93), comprising:

a conductive base support (20) of a length greater than the width of the pole and whose surfaces (44,58) are oriented predominantly in the vertical direction;

connection means for attaching a ground wire (24) to said base support (20);

means for fastening (48,97) the base support (20) at or near the base of the pole (12) such that at least a portion of the conductive base support (20) extends below the bottom (22) of the pole (12) a distance greater than the width of the pole or post;

said portion of the conductive base support extending a sufficient length so as to be penetrable into the undisturbed ground (93) beneath the disturbed ground at the bottom (98) of the hole (94) and so as to be engageable with the undisturbed ground (93) beneath the hole (94) to resist lateral and/or rotational forces exerted on the pole (12) after installation.

3. The combination pole support and electrical grounding arrangement as claimed in claim 2, wherein the portion of the base support (20) which extends below the bottom (22) of the pole (12) comprises a plurality of substantially vertically oriented surfaces (44,58).

4. The combination pole support and electrical grounding arrangement as claimed in claim 3 wherein at least one of the vertically oriented surfaces (58) is disposed at an angle to one or more of the other vertically oriented surfaces (44).

5. The combination pole support and electrical grounding arrangement as claimed in claim 4 wherein said at least one of the vertically oriented surfaces (58) includes a driving edge which is the only portion of the base support (20) which contacts the bottom surface (22) of the pole (12).

6. The combination pole support and electrical grounding arrangement as claimed in claim 5, wherein the base support comprises:

a vertically oriented spade portion spade portion (42) having an upper end fastenable to the side of the pole (12) near its bottom (22), and a vertically oriented driving member (50) which includes the driving edge, said driving member (50) extending generally transversely to the spade portion (42).

7. The combination pole support and electrical grounding arrangement as claimed in claim 2, wherein the base support (20) is provided with a finish which inhibits oxidation.

8. The combination pole support and electrical grounding arrangement as claimed in claim 2, wherein the base support (20) is made from a material which inhibits oxidation.

9. The combination pole support and electrical grounding arrangement as claimed in claim 2, further comprising a ground wire (24).

10. The combination pole support and electrical grounding arrangement as claimed in claim 8, wherein the ground wire (24) is welded to the base support (20).

11. The combination pole support and electrical grounding arrangement as claimed in claim 2, further comprising an upper support assembly (14) for supporting the upper portion of the underground portion of the pole against lateral and/or rotational forces.

12. The combination pole support and electrical grounding arrangement as claimed in claim 11, wherein said upper support assembly (14) is positioned in the hole (94) prior to insertion of the pole (12) and comprises an arcuate collar (16) having a plurality of blades (18) pivotably attached thereto, said blades (18) being extendable generally radially into the sides of the hole.

* * * * *

UNITED STATES PATENT AND TRADEMARK OFFICE

CERTIFICATE OF CORRECTION

PATENT NO. : 6,815,607 B1
DATED : November 9, 2004
INVENTOR(S) : Marc Gingras

It is certified that error appears in the above-identified patent and that said Letters Patent is hereby corrected as shown below:

Title page,
Item [22], PCT filing date, should read -- November 1, 2000 --.

Signed and Sealed this

Fifth Day of April, 2005

JON W. DUDAS
*Director of the United States Patent and Trademark Office*